US009576508B2

(12) United States Patent
Stiel et al.

(10) Patent No.: US 9,576,508 B2
(45) Date of Patent: Feb. 21, 2017

(54) LABEL AND RELATED METHOD

(75) Inventors: Amy Stiel, Mooresville, NC (US); Terence Leung, Hong Kong (CN); Barry Van Dyk, New York, NY (US)

(73) Assignee: AVERY DENNISON RETAIL INFORMATION SERVICES, LLC, Westborough, MA (US)

( * ) Notice: Subject to any disclaimer, the term of this patent is extended or adjusted under 35 U.S.C. 154(b) by 697 days.

(21) Appl. No.: 12/522,541

(22) PCT Filed: Jan. 10, 2008

(86) PCT No.: PCT/US2008/050804
§ 371 (c)(1),
(2), (4) Date: Jan. 12, 2010

(87) PCT Pub. No.: WO2008/089046
PCT Pub. Date: Jul. 24, 2008

(65) Prior Publication Data

US 2010/0124637 A1 May 20, 2010

Related U.S. Application Data

(60) Provisional application No. 60/884,777, filed on Jan. 12, 2007.

(51) Int. Cl.
*G09F 3/02* (2006.01)
*D06M 15/21* (2006.01)

(52) U.S. Cl.
CPC ..... *G09F 3/02* (2013.01); *Y10T 428/2481* (2015.01); *Y10T 428/24785* (2015.01); *Y10T 442/20* (2015.04); *Y10T 442/3976* (2015.04)

(58) Field of Classification Search
CPC ..... Y10T 428/24785; Y10T 428/2481; Y10T 442/20; Y10T 442/3976; G09F 3/02
USPC ..... 442/181
See application file for complete search history.

(56) References Cited

U.S. PATENT DOCUMENTS

| | | | | |
|---|---|---|---|---|
| 3,607,573 A * | 9/1971 | Michaelides et al. | ..... | 156/511 |
| 3,932,124 A * | 1/1976 | Wasley et al. | ..... | 442/152 |
| 4,534,819 A * | 8/1985 | Payet et al. | ..... | 156/515 |
| 4,577,665 A * | 3/1986 | Diesner | ..... | 139/431 |
| 5,112,420 A | 5/1992 | Diesner | | |
| 5,658,647 A * | 8/1997 | Magill et al. | ..... | 428/195.1 |

(Continued)

FOREIGN PATENT DOCUMENTS

| | | |
|---|---|---|
| CN | 1503962 A | 6/2004 |
| GB | 2228916 | 9/1990 |

(Continued)

OTHER PUBLICATIONS

PRWeb, "Clothing Labels Expose—BCI Corporation's Elegant Woven Label Selection Transforms Small Clothiers into Big Time Fashionistas," Press Release dated Jun. 13, 2006.*

(Continued)

*Primary Examiner* — Jeremy R Pierce
(74) *Attorney, Agent, or Firm* — Avery Dennison Retail Information Services, LLC

(57) ABSTRACT

A label and related method of manufacture that includes a fabric made of yarn. The yarn includes a fiber that has been recycled, that is recyclable, that is organic, that is biodegradable, and/or that can be derived from a material that is known to be environmentally friendly.

10 Claims, 3 Drawing Sheets

(56) References Cited

U.S. PATENT DOCUMENTS

| | | | | |
|---|---|---|---|---|
| 6,103,364 | A * | 8/2000 | Harris et al. | 428/326 |
| 6,884,491 | B2 | 4/2005 | Rubin et al. | |
| 7,094,733 | B2 | 8/2006 | Laney et al. | |
| 2001/0051265 | A1 * | 12/2001 | Williams et al. | 428/343 |
| 2003/0220036 | A1 | 11/2003 | Lee | |
| 2004/0244902 | A1 * | 12/2004 | Bleckmann | 156/227 |
| 2005/0131103 | A1 * | 6/2005 | Hassan et al. | 523/160 |
| 2006/0070681 | A1 * | 4/2006 | Haroutoonian et al. | 139/383 R |
| 2006/0135668 | A1 | 6/2006 | Hayes | |
| 2006/0282958 | A1 * | 12/2006 | Yang | D01F 4/00 8/116.1 |

FOREIGN PATENT DOCUMENTS

| | | |
|---|---|---|
| GB | 2384479 | 7/2003 |
| WO | 02/084630 | 10/2002 |

OTHER PUBLICATIONS

Abstract for Knudsen, H.H. and Wenzel, H., "Environmentally friendly method in reactive dyeing of cotton," Water Sci. Tech., vol. 33 No. 6 pp. 17-27 IWA Publishing 1996, available at http://www.iwaponline.com/wst/03306/wst033060017.htm.*

Wikipedia entry for "Organic Cotton," 1st sentence, available at http://en.wikipedia.org/wiki/Organic_cotton.*

Supplementary European Search Report dated Nov. 13, 2009 from corresponding European Application No. 08713717.0.

International Search Report and Written Opinion dated May 16, 2008 from corresponding International Application No. PCT/US2008/50804.

International Preliminary Report on Patentability dated Apr. 29, 2009 from corresponding International Application No. PCT/US2008/50804.

* cited by examiner

LABEL AND RELATED METHOD

CROSS-REFERENCE TO RELATED APPLICATIONS

Priority is claimed to U.S. Provisional Patent Application No. 60/884,777, filed on Jan. 12, 2007, entitled "Environmentally Friendly Woven Label," by Amy Stiel, Terence Leung, and Barry Vandyk, and International Patent Application No. PCT/US08/50804, filed on Jan. 10, 2008, entitled "Label And Related Method," by Amy Stiel Terence Leung, and Barry Vandyk, which applications are incorporated by reference herein in their entireties.

FIELD OF THE INVENTION

The present invention generally relates to labels. More specifically, the invention relates to labels that are constructed from various types of environmentally friendly materials.

BACKGROUND

Currently, printed fabric labels are made of conventional yarns that are derived from synthetic fibers or natural fibers, i.e., fibers that are derived from materials grown using chemical fertilizers and/or pesticides. The base materials and the processes used to manufacture these conventional yarns can have a negative impact on the environment. Furthermore, the resulting printed fabric labels that are non-recyclable and non-biodegradable can have a negative impact on the environment. It should, therefore, be appreciated that there is a need for labels that have less of an impact on the environment. The present invention satisfies this need.

SUMMARY

The present invention includes labels that have little effect on the environment. An exemplary embodiment is a label that includes a fabric made of yarn. The yarn includes a fiber that has been recycled, that is recyclable, that is organic, that is biodegradable, and/or that has been derived from a material that is known to be environmentally friendly.

In other, more detailed features of the invention, the label is a printed label. Also, the fabric can be a woven-edge narrow fabric or a slit-edge broad good fabric. In addition, the label can be a printed label, where the fabric is printed with a standard ink, a soy-based ink, a water-based ink, and/or an ink that is known to be environmentally friendly.

In other, more detailed features of the invention, the yarn is derived from soy, bamboo, plant fiber, recycled polyester, cellulose-based fiber, natural fiber, and/or organically grown cotton. Also, the yarn can include a blend of a first yarn and a second yarn, where the first yarn is a standard synthetic polyester yarn and/or a natural cotton yarn, and the second yarn is derived from soy, bamboo, plant fiber, recycled polyester, cellulose-based fiber, organically grown cotton, and/or natural fiber.

In other, more detailed features of the invention, the fabric is a dyed fabric, and the fabric has been dyed using an environmentally friendly dye and/or an environmentally friendly dyeing process. Also, the fabric can be dyed using a custom color.

In other, more detailed features of the invention, the label is recyclable and/or biodegradable. Also, the label can further include locations having yarn fiber blends that are configured to facilitate fusing and/or sealing. In addition, the words "environmentally friendly" mean considered to minimize the impact on, or inflict little to no harm on, the environment.

Another exemplary embodiment is a printed label that includes a fabric made of yarn. The yarn is derived from soy, bamboo, plant fiber, recycled polyester, cellulose-based fiber, organically grown cotton, and/or natural fiber. The yarn includes a fiber that has been recycled, that is recyclable, that is organic, that is biodegradable, and/or has been derived from a material that is known to inflict little to no harm on the environment. The fabric is printed with a standard ink, a soy-based ink, a water-based ink, and/or an ink that is known to inflict little to no harm on the environment.

An exemplary method according to the invention is a method for manufacturing a fabric to be used in a label. The method includes using yarn to create the fabric. The yarn includes a recycled fiber, a recyclable fiber, an organic fiber, a biodegradable fiber, and/or a fiber that has been derived from a material that is known to be environmentally friendly. In other, more detailed features of the invention, the fabric is manufactured using a Jacquard Broad loom and/or a Jacquard Needle loom.

Other features of the invention should become apparent to those skilled in the art from the following description of the preferred embodiments taken in conjunction with the accompanying drawings, which illustrate, by way of example, the principles of the invention, the invention not being limited to any particular preferred embodiment(s) disclosed.

BRIEF DESCRIPTION OF THE DRAWINGS

These and other features, aspects, and advantages of the present invention will become better understood with reference to the following description, appended claims, and accompanying drawings, where:

Unless otherwise indicated, the illustrations in the above figures are not necessarily drawn to scale.

DETAILED DESCRIPTION

Figure 1:
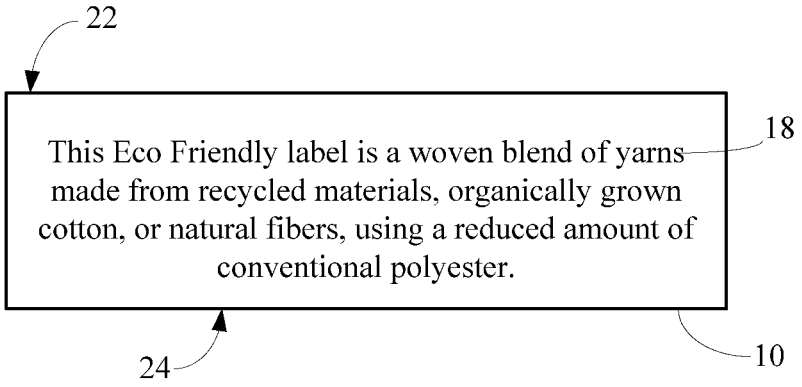
FIG. 1 is top plan view of a label according to a preferred embodiment.
Figure 2:
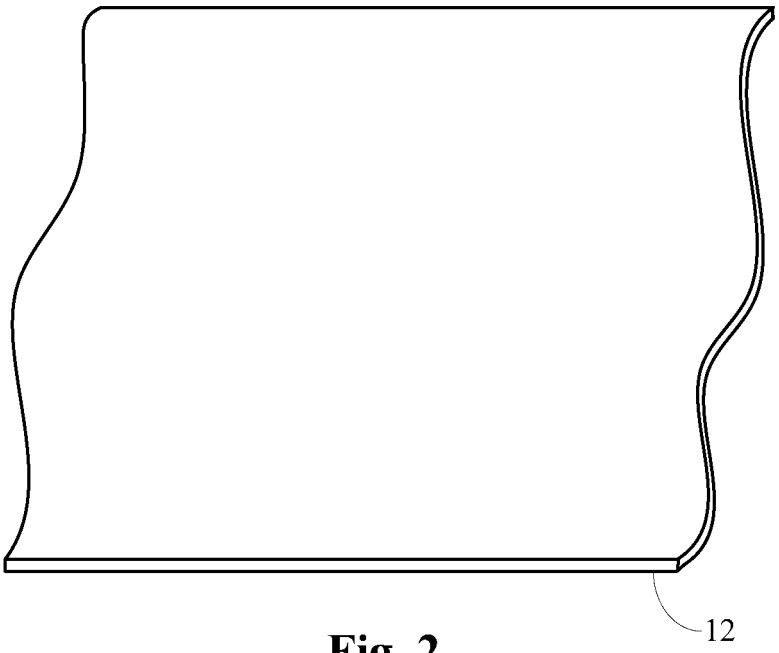
FIG. 2 is perspective view of a piece of fabric according to a preferred embodiment.
Figure 3:
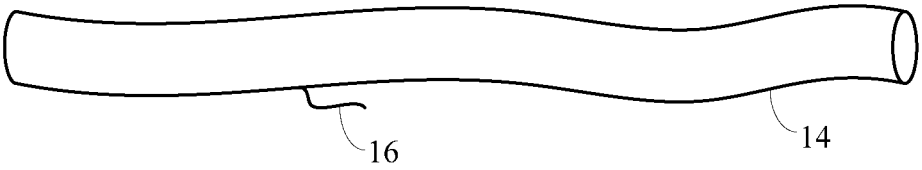
FIG. 3 is a perspective view of a piece of yarn and a fiber that is coupled to the piece of yarn according to a preferred embodiment.

Referring to FIGS. 1-3, the present invention is embodied in printed fabric labels 10 that are produced from fabric 12, for example, on woven-edge narrow fabrics or slit-edge broad good fabrics, and that include warp and/or fill yarns 14 that are constructed using some percentage of fibers 16 (from a percentage greater than 1% and up to 100%) that are recycled, recyclable, organic, biodegradable, or derived from natural or synthetic fibers that are known to be environmentally friendly. Organic fibers are derived from organically grown materials, i.e., materials that are grown without the use of chemical fertilizers and/or chemical pesticides. These fabric labels can be printed with ink 18, for example, either standard inks, soy-based inks, water-based ink, or other inks that are known to be environmentally friendly. Examples of standard inks include the following: COLORMAX inks from Avery Dennison Corporation of Pasadena, Calif., TEXPRINT inks for rotary letter presses from Ink Tec Inc. of Newton, N.C., and FABRIFAST and DT TYPE letterpress inks from Perfectos Specialty Inks Ltd. of Nottingham, England. Throughout this document, the words "environmentally friendly" are synonymous with the words "environmentally acceptable" and mean designed to minimize the impact on, or cause or inflict little or no harm to, the environment. Advantageously, environmentally friendly items, e.g., environmentally friendly materials, yarns, fibers, inks, dyes, dye color, and dyeing processes, have less of an impact on the environment in comparison to corresponding conventional items. These printed fabric labels are used for brand identification of both "soft-line" and "hard-line" commercial retail goods. The labels can be of varying sizes and shapes, for example, although not shown to scale, the rectangular label shown in FIG. 1 can be approximately 24 millimeters by approximately 72 millimeters.

Embodiments of printed labels 10 on woven-edge narrow or slit-edge broad fabrics 12 using yarn fiber blends in the warp and fill include standard synthetic polyester or natural cotton yarns 14 combined with various amounts of some or all of the following: yarns derived from organically grown cotton, yarns derived from soy, yarns derived from bamboo, and yarns derived from other plant fibers. Additional embodiments of printed labels include standard synthetic polyester or natural cotton yarns combined with various amounts of some or all of the following: yarns made from recycled polyester, and yarns made from cellulose-based fibers such as Lyocell®, which is made by Lenzing Fibers Inc. of New York, N.Y. Further embodiments of printed labels include 100% of the following: yarns derived from organically grown cotton, yarns derived from soy, yarns derived from bamboo, yarns derived from plant fibers, yarns made from recycled polyester, and yarns made from cellulose-based fibers such as Lyocell®.

Other embodiments of labels 10 that have been printed on woven-edge narrow or slit-edge broad fabrics 12 also have been dyed using dyes and/or dyeing processes that are known to be environmentally friendly. These dyed labels use yarn fiber blends in the warp and fill that include standard synthetic polyester or natural cotton yarns 14 combined with various amounts of some or all of the following: yarns derived from organically grown cotton, yarns derived from soy, yarns derived from bamboo, and yarns derived from other plant fibers. Also, these dyed labels can include standard synthetic polyester or natural cotton yarns combined with various amounts of some or all of the following: yarns made from recycled polyester, and yarns made from cellulose-based fibers such as Lyocel®. Furthermore, these dyed labels can include 100% of the following: yarns derived from organically grown cotton, yarns derived from soy, yarns derived from bamboo, yarns derived from plant fibers, yarns made from recycled polyester, and yarns made from cellulose-based fibers such as Lyocell®.

Embodiments of labels 10 are printed on woven-edge narrow or slit-edge broad fabrics 12 using inks 18 that are soy-based, water-based, or inks known to be environmentally friendly, and the fabrics include yarn fiber blends in the warp and fill including standard synthetic polyester or natural cotton yarns 14 combined with various amounts of some or all of the following: yarns derived from organically grown cotton, yarns derived from soy, yarns derived from bamboo, and yarns derived from other plant fibers. Embodiments of the ink-printed labels can include fabrics having standard synthetic polyester or natural cotton yarns combined with various amounts of some or all of the following: yarns made from recycled polyester, and yarns made from cellulose-based fibers such as Lyocell®. Additionally, embodiments of the ink-printed labels can include 100% of the following: yarns derived from organically grown cotton, yarns derived from soy, yarns derived from bamboo, yarns derived from plant fibers, yarns made from recycled polyester, and yarns made from cellulose-based fibers such as Lyocell®.

Figure 4:
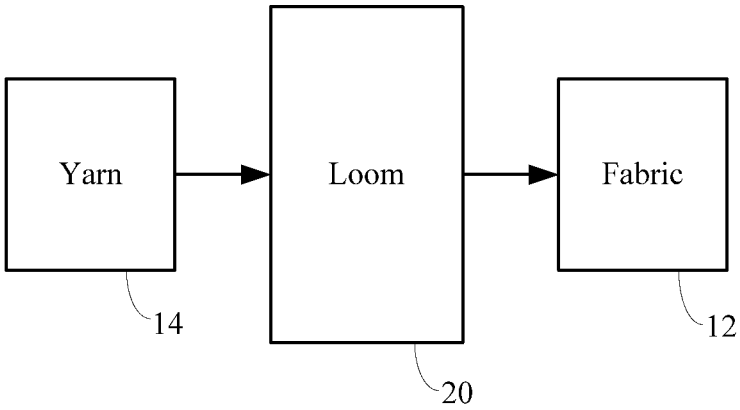
FIG. 4 is block diagram of yarn being input to a loom that outputs fabric according to a preferred embodiment.

Embodiments include labels 10 that are printed on woven-edge narrow or slit-edge broad fabrics 12 that are recyclable and/or are biodegradable. Referring additionally to FIG. 4, the labels, for example, woven narrow fabric labels, can be produced using a loom 20, for example, a Jacquard Broad loom or a Needle loom. Also, the labels can be produced using yarn fiber blends in the warp and weft that consisting of standard synthetic polyester yarns combined with various amounts of and/or all consisting of natural fiber yarns having qualities known to be environmentally friendly. Woven Jacquard labels manufactured from man-made synthetic fibers are often deemed harmful to the environment, while organically grown or natural fibers 16, as well as fibers from recycled materials, are all considered friendlier to the environment.

Embodiments of woven narrow fabric labels 10 that are produced in Jacquard Broad or Needle looms 20 using yarn fiber blends in the warp and weft can, for example, include standard synthetic polyester yarns 14 combined with various amounts of, and/or all of, the following natural fiber yarns having qualities that are known to be environmentally friendly: yarns derived from organically grown cotton, yarns derived from soy, and yarns derived from bamboo. The embodiments of woven narrow fabric labels that are produced in Jacquard Broad looms or Needle looms using yarn fiber blends in the warp and weft can, for example, include standard synthetic polyester yarns combined with various amounts of and/or all of the following man-made fiber yarns having qualities that are known to be environmentally friendly: polyester yarns manufactured from recycled substances, and yarns derived from cellulose, known as Lyocell®. In further example embodiments of woven narrow fabric labels that are produced in Jacquard Broad looms or Needle looms using yarn fiber blends in the warp and weft, the labels can include 100% natural fiber blends of yarns, excluding any synthetic polyester or any type of man-made fiber, using combinations of the following yarns that are known to be environmentally friendly: yarns derived from organically grown cotton, yarns derived from soy, and yarns derived from bamboo.

Embodiments of woven narrow fabric labels 10 that are produced in Jacquard Broad or Needle looms 20 using yarn fiber blends consisting of dyes and/or dyeing processes that are known to be environmentally friendly in the warp and weft can include standard synthetic polyester yarns 14 combined with various amounts of, and/or all of, the following natural fiber yarns having qualities that are known to be environmentally friendly, which have been dyed in "custom" colors using environmentally friendly dyes and/or dyeing processes: yarns derived from organically grown cotton, yarns derived from soy, and yarns derived from bamboo. Additional embodiments of woven narrow fabric labels that are produced in Jacquard Broad looms or Needle looms using yarn fiber blends consisting of dyes and/or dyeing processes that are known to be environmentally friendly in the warp and weft can include standard synthetic polyester yarns combined with various amounts of and/or all of the following man-made fiber yarns having qualities that are known to be environmentally friendly, which have been dyed in "custom" colors using environmentally friendly dyes and/or dyeing processes: polyester yarns manufactured from recycled substances, and yarns derived from cellulose, known as Lyocel®. Further embodiments of woven narrow fabric labels that are produced in Jacquard Broad looms or Needle looms using yarn fiber blends consisting of dyes and/or dyeing processes that are known to be environmentally friendly in the warp and weft can include 100% natural fiber blends of yarns, excluding any synthetic polyester or any type of man-made fiber, using combinations of the following yarns having qualities that are known to be environmentally friendly, which have been dyed in "custom" colors using environmentally friendly dyes and/or dying processes: yarns derived from organically grown cotton, yarns derived from soy, and yarns derived from bamboo.

Embodiments of woven narrow fabric labels 10 that are produced in Jacquard Broad or Needle looms 20 can include yarn fiber blends in specific locations, e.g., a first example location 22 and a second example location 24, of the label construction to ensure proper fusing/sealing at the point of the cutting area. These embodiments that ensure proper fusing/sealing can use natural fiber warp yarns 14 known to be environmentally friendly and that, for example, can include 100% natural fiber warp yarns that are known to be environmentally friendly combined with weft yarns either being synthetic or from recycled materials, which are woven specifically only in the cutting area 22 and 24 for approximately 3 mm-6 mm wide, from selvedge to selvedge, to ensure proper fusing/sealing of the heat cut edge. The warp and/or weft yarns can be derived from soy, bamboo, and/or organically grown cotton.

Figure 5:
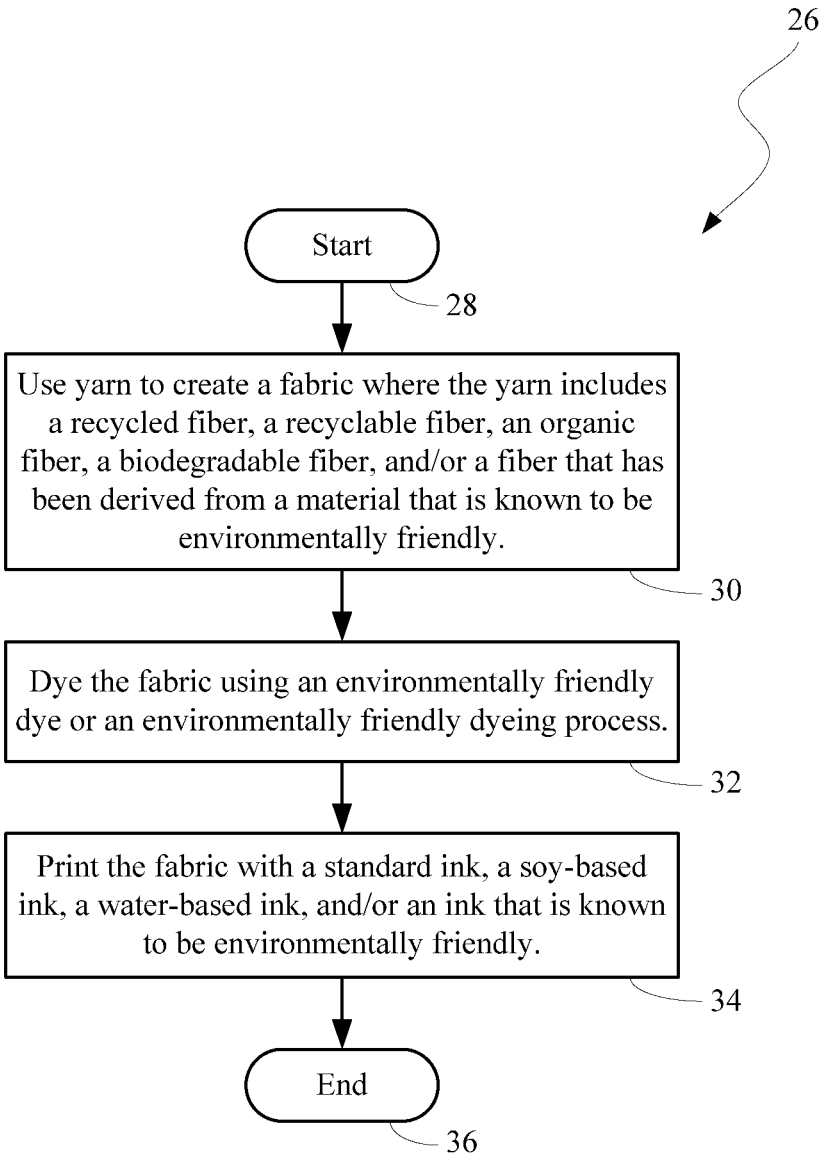
FIG. 5 is a flowchart of an example method for manufacturing a fabric to be used in a label according to the invention.

An exemplary method for manufacturing a fabric 12 to be used in a label 10 according to the present invention is illustrated in the algorithm 26 of FIG. 5. After starting the method at step 28, the next step 30 is to use yarn 14 to create the fabric, where the yarn includes a recycled fiber, a recyclable fiber, an organic fiber, a biodegradable fiber, and/or a fiber that has been derived from a material that is known to be environmentally friendly 16. Next, at step 32, the fabric is dyed using an environmentally friendly dye or an environmentally friendly dyeing process. Next, at step 34, the fabric is printed with a standard ink, a soy-based ink, a water-based ink, and/or an ink that is known to be environmentally friendly 18. The method ends at step 36.

All features disclosed in the specification, including the claims, abstract, and drawings, and all of the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

The foregoing detailed description of the present invention is provided for purposes of illustration, and it is not intended to be exhaustive or to limit the invention to the particular embodiments disclosed. The embodiments may provide different capabilities and benefits, depending on the configuration used to implement the key features of the invention. Accordingly, the scope of the invention is defined only by the following claims.

We claim:

1. A label comprising:

a. a fabric made of a yarn wherein the fabric is selected from the group consisting of a woven-edge narrow fabric and a slit-edge broad fabric;

b. wherein the yarn includes a plurality of fiber blends in which at least one fiber is selected from the group consisting of a recycled fiber, a recyclable fiber, an organic fiber, and a biodegradable fiber and the fiber blends are in specific locations of the label to ensure proper fusing/sealing at the point of cutting; and label locations that include yarn fiber blends that are configured to facilitate an action selected from the group consisting of fusing a heat-cut edge of the label and sealing a heat-cut edge of the label;

wherein the fiber is combined with at least one weft yarn and the fiber combined with the at least one weft yarn is woven only at the point of cutting; and wherein the fabric is dyed and the fabric is printed with an ink selected from the group consisting of a standard ink, a soy-based ink, and a water-based ink.

2. The label according to claim 1, wherein the yarn is selected from the group consisting of a yarn derived from soy, a yarn derived from bamboo, a yarn derived from plant fiber, a yarn made of recycled polyester, a yarn made of a cellulose-based fiber, a yarn derived from organically grown cotton, and a yarn derived from a natural fiber.

3. The label according to claim 1, wherein:

a. the yarn includes a blend of a first yarn and a second yarn;

b. the first yarn is selected from the group consisting of a standard synthetic polyester yarn and a natural cotton yarn; and c. the second yarn is selected from the group consisting of a yarn derived from soy, a yarn derived from bamboo, a yarn derived from plant fiber, a yarn made of recycled polyester, a yarn made of a cellulose-based fiber, a yarn derived from organically grown cotton, and a yarn derived from a natural fiber.

4. The label according to claim 1, wherein the fabric has been dyed using a custom color.

5. The label according to claim 1, wherein the label has a characteristic selected from the group consisting of being recyclable and being biodegradable.

6. The label according to claim 1, wherein the yarn is selected from the group consisting of a yarn derived from soy, a yarn derived from bamboo, a yarn made of recycled polyester and a yarn derived from organically grown cotton.

7. A label comprising:

a. a fabric made of a yarn;

b. the yarn includes a blend of a first yarn and a second yarn;

c. the first yarn is selected from the group consisting of a standard synthetic polyester yarn and a natural cotton yarn;

d. the second yarn is derived from soy;

label locations that include yarn fiber blends that are configured to facilitate an action selected from the group consisting of fusing a heat-cut edge of the label and sealing a heat-cut edge of the label; and wherein the fabric is selected from the group consisting of a woven-edge narrow fabric and a slit-edge broad fabric and the fiber is also combined with at least one weft yarn and the fiber combined with at least one weft yarn is woven only at the point of cutting, and the label is printed with an ink that is a water-based ink, or a combination of water and soy based inks.

8. The label of claim 7, wherein the first yarn is a synthetic polyester yarn.

9. The label of claim 7, wherein at least the first or the second yarn is dyed.

10. The label according to claim 1, wherein the fabric is slit-edge broad fabric.

* * * * *